US008894278B2

(12) United States Patent
Verch, Jr. et al.

(10) Patent No.: US 8,894,278 B2
(45) Date of Patent: Nov. 25, 2014

(54) AUTOMATED DEWPOINT OXYGEN MEASUREMENT SYSTEM

(75) Inventors: Manfried Carl Verch, Jr., Wallingford, CT (US); Peter N. Horniak, Wallingford, CT (US)

(73) Assignee: United Technologies Corporation, Hartford, CT (US)

( * ) Notice: Subject to any disclaimer, the term of this patent is extended or adjusted under 35 U.S.C. 154(b) by 358 days.

(21) Appl. No.: 13/345,361

(22) Filed: Jan. 6, 2012

(65) Prior Publication Data

US 2013/0177038 A1 Jul. 11, 2013

(51) Int. Cl.
*G01N 25/02* (2006.01)

(52) U.S. Cl.
USPC ..... 374/28; 374/141; 374/178

(58) Field of Classification Search
CPC ..... G01N 25/68; G01N 25/66; G01N 25/18; G01N 19/10; G01N 25/02; F24F 11/0015
See application file for complete search history.

(56) References Cited

U.S. PATENT DOCUMENTS

| | | | | |
|---|---|---|---|---|
| 6,857,173 | B1 * | 2/2005 | Crane et al. | 29/33 M |
| 6,881,439 | B2 | 4/2005 | Graham et al. | |
| 7,276,209 | B2 * | 10/2007 | Jossart | 422/111 |
| 7,888,233 | B1 | 2/2011 | Gauri et al. | |
| 7,897,525 | B2 | 3/2011 | Lei et al. | |
| 2009/0317545 | A1 | 12/2009 | Henager, Jr. et al. | |
| 2010/0159136 | A1 * | 6/2010 | Lee et al. | 427/255.39 |
| 2011/0126592 | A1 * | 6/2011 | De Angelis et al. | 65/90 |

* cited by examiner

*Primary Examiner* — Lisa Caputo
*Assistant Examiner* — Janice M Soto
(74) *Attorney, Agent, or Firm* — Miller, Matthias & Hull LLP

(57) ABSTRACT

An apparatus and method to automate the process of measuring and verifying trace gas levels such as oxygen and dewpoint inside a retort used to coat or heat treat substrates are provided. The apparatus may include an integrated measuring system, and an operator interface. The method may include coupling the apparatus to the retort in which the substrate is coated or heat treated, activating the integrated measuring system to measure and verify atmospheric conditions within the retort, and providing operator access to process parameters and status through the operator interface. The measurement and verification system may be completely autonomous.

20 Claims, 8 Drawing Sheets

AUTOMATED DEWPOINT OXYGEN MEASUREMENT SYSTEM

FIELD OF THE DISCLOSURE

The present disclosure generally relates to systems and methods for coating or heat treating a substrate, and in particular to automated measurement and verification systems for assuring a retort used for such operations meets suitable dewpoint and oxygen levels prior to engaging in same.

BACKGROUND OF THE DISCLOSURE

In manufacturing many industrial parts, coatings of a particular material to the parts need to be applied to exacting standards. In others, heat treatments of the parts has to be undertaken to precise standards as well. Any deviation away from those standards or thresholds can result in malfunctioning components. If those components are used, the overall machine in which they are employed may under-perform. Accordingly, they are often rigorously tested prior to installation. If they are not sufficient, the parts are either scrapped or remachined. Either way, the result is added cost and lessened efficiency.

One example where this is currently problematic is in the manufacture of turbines and other components used in gas turbine engines and other aircraft components. With turbines, for example, aluminide or other coatings often need to be applied. Currently, prior to application of such coatings, the retort or chamber environment in which the component is coated needs to be purged with argon or another inert gas to establish proper coating conditions. An operator not only needs to manually do this, but then manually verify it with dewpoint and oxygen measurements. These measurements require the operators to manually connect a dewpoint and oxygen meter to the retort and follow a specific procedure to assure all process parameters are achieved before proceeding. If they are not adhered to, it may cause deficiencies in the processed parts as well as damage to the measuring equipment.

Not only is this manual verification labor intensive, but prone to human error. For example, the repetition of the task throughout the day may lead to tedium and mistakes. Moreover, the manual purging and verification process occupies the operator, often precluding him or her from performing any other task, thus slowing production. Accordingly, it would be beneficial to have an automated measuring system to eliminate scrap/rework due to improper coating or heat treating environments, and to prolong the life of the process measuring equipment by avoiding human error in the manual operation. Moreover, it would be beneficial to allow for increased productivity and reduced costs by allowing the operator to monitor multiple stations and by minimizing human intervention in the manufacturing process.

SUMMARY OF THE DISCLOSURE

In accordance with one aspect of the disclosure, an apparatus for automating dewpoint and oxygen level verification within a retort for coating or heat treating substrates is disclosed, which may include an integrated measuring system being communicatively coupled to the retort and measuring dewpoint and oxygen conditions inside the retort, and an operator interface communicatively coupled to the integrated measuring system, the operator interface automatically communicating whether dewpoint and oxygen levels inside the retort are within an acceptable range.

In accordance with another aspect of the disclosure, a method for automating dewpoint and oxygen level verification within a retort for coating or heat treating substrates is disclosed, which may include the steps of providing an integrated measuring system communicatively coupled to the retort and measuring dewpoint and oxygen conditions inside the retort, an operator interface communicatively coupled to the integrated measuring system for automatically communicating whether dewpoint and oxygen levels within the retort are within an acceptable range, purging the retort, activating the integrated measuring system, and verifying dewpoint and oxygen levels within the retort using the integrated measuring system.

In accordance with yet another aspect of the disclosure, an apparatus for automating dewpoint and oxygen level verification within a retort for coating or heat treating substrates prior to coating is disclosed, which may include dewpoint and oxygen sensors, a processor receiving signals for the dewpoint and oxygen sensors indicative of dewpoint and oxygen levels, respectively, and an operator interface automatically communicating whether dewpoint and oxygen levels within the retort are with an acceptable range.

BRIEF DESCRIPTION OF THE DRAWINGS

The disclosure itself, and advantages thereof, will best be understood by reference to the following detailed description of illustrative embodiments when read in conjunction with the accompanying drawings, wherein.

DETAILED DESCRIPTION

Figure 1:
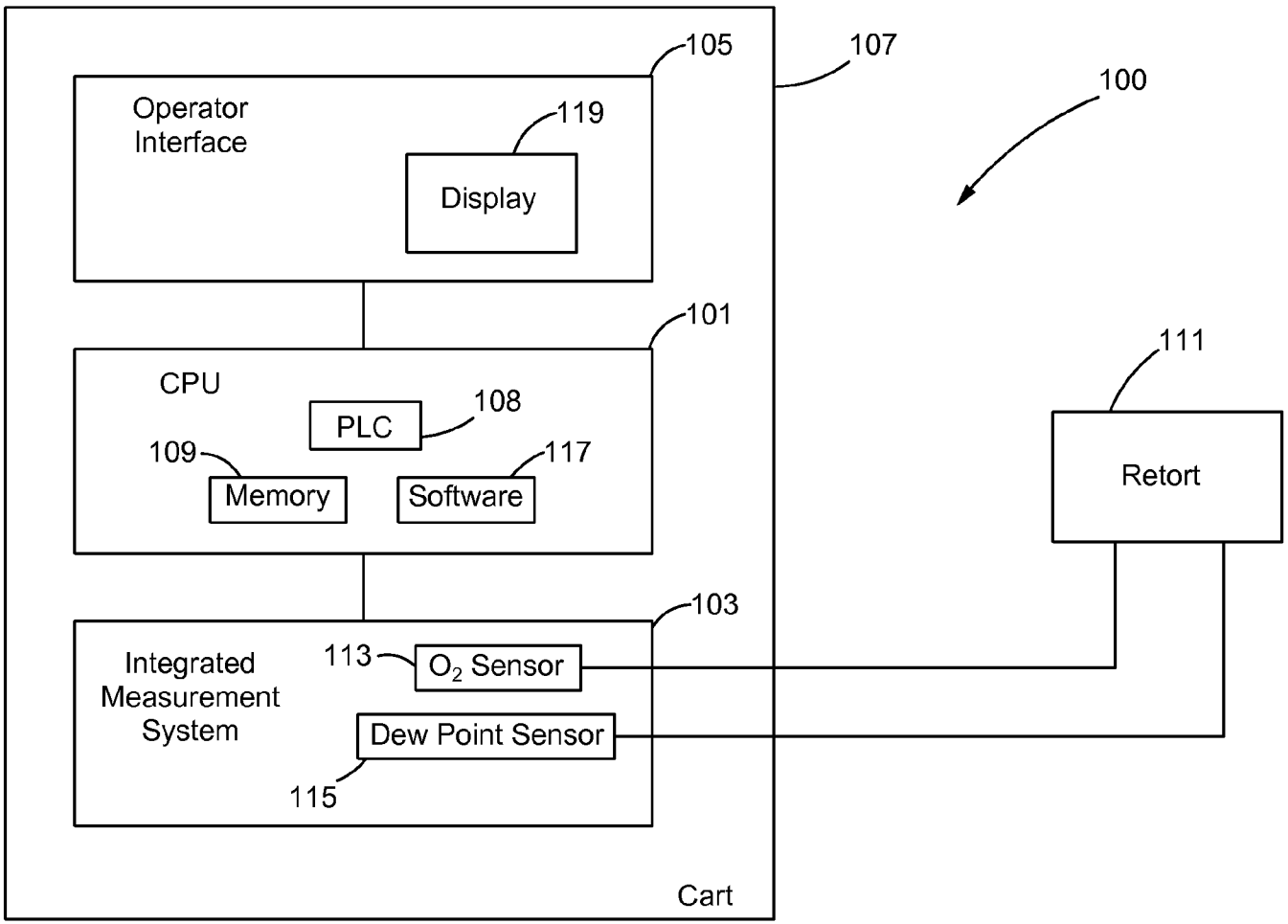
FIG. 1 is a block diagram representation of the automated measurement and verification computer system, according to some embodiments of the disclosure.

The disclosure and various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the disclosure. The examples used herein are intended merely to facilitate an understanding of ways in which the embodiments of the disclosure may be practiced and to further enable those of skill in the art to practice the embodiments of the disclosure. Accordingly, the examples should not be construed as limiting the scope of the disclosure.

Referring now to the drawings, and with specific reference to FIG. 1, a block diagram of the automated measurement and verification system 100 according to some embodiments of the present disclosure is shown. The system 100 may generally include a central processing unit (CPU) 101, an integrated measuring system 103, and an operator interface 105.

Each of the foregoing components may be provided on a self-contained portable unit, such as a cart 107 as will be described in greater detail as disclosed herein.

Breaking the foregoing parts down further and starting with the central processing unit 101, it may be provided in many different forms including, but not limited to, that of a programmable logic controller (PLC) 108. The CPU or PLC may include an internal or external memory 109. The integrated measurement system 103 may include trace or process gas analyzers and sensors to measure and verify atmospheric conditions inside a retort 111. For example, the integrated measurement system 103 may include an oxygen sensor 113 and a dewpoint sensor 115. As will be described in further detail herein, the integrated measurement system 103 automates the process of measuring trace gases and atmospheric conditions such as dewpoint and moisture content within the retort.

The operator interface 105 for either automated or semi-automated operation of the integrated measurement system 103 may be provided by any number of input/output (I/O) devices including, but not limited to, a touch screen display, tablet, mobile, or portable device that may physically attached or docked to the automated measurement and verification system 100.

The memory 109 may be part of the PLC, and may include separate high speed random access memory and non-volatile memory, such as one or more magnetic disk storage devices. The memory 109 may alternately include mass storage that is remotely located from the PLC, or may comprise a computer readable storage medium. Memory 109 may store software 117 run by the automated measurement and verification system 100.

The automated measurement and verification system 100 may be configured for semi-automated substrate processing allowing an operator to enter desired atmospheric conditions via the operator interface 105 and then enabling measurement and verification of atmospheric conditions inside the retort 111. The operator is then notified through operator interface 105 that substrate processing under the desired atmospheric conditions can begin, or that such processing cannot begin due to atmospheric conditions having fallen outside operator defined values.

The automated measurement and verification system of the present disclosure may be performed on a wide-range of retorts. A "retort" in the context of the present disclosure may be any type of chamber with at least one opening and a wall defining an interior space containing a gas atmosphere. If the retort has two or more openings, the openings may be of the same or different size. If there is more than one opening, one opening may be used for the gas inlet for a process method, (e.g. a deposition method such as PECVD), while the other openings are either capped or open. The system may be implemented on any retort equipped for any type of process method, including but not limited to, deposition, annealing, coating, heat treatment, and the like, and any combination thereof, used in the processing of a substrate. For example, such processing methods include without limitation: chemical vapor deposition (CVD), plasma enhanced chemical vapor deposition (PECVD), atomic layer deposition (ALD), high density plasma (HDP), pulsed nucleation layer (PNL), pulsed deposition layer (PDL), physical vapor deposition (PVD), annealing furnace, rapid thermal annealing (RTP) furnace, atmospheric pressure CVD (APCVD), sub-atmospheric chemical vapor deposition (SACVD), vapor phase aluminizing techniques (VPA), etching chambers, sintering chambers, spin on chambers, oxidation-resistant environmental coatings, thermally-sprayed bonding coating, pack cementation, slurry coatings, thermal barrier coating (TBC) (e.g. air plasma spraying (APS), vacuum plasma spraying (VPS), high velocity oxy-fuel (HVOF), etc.,), plating (including electroplating and electroless plating) chambers, evaporative coating chambers, the like, and combinations thereof.

A "substrate" in the context of the present disclosure may, in particular, be, but not be limited to, an aircraft part or component. However, it may also be any other material such as, but not limited to, superconducting, non-conducting, or semiconducting material; intermetallic compound; metal; metal alloy, super alloy, plastic, wood, paper, glass, ceramic, organic, polymeric, or compound material.

A "process gas" or "trace gas" as used herein may be a single gas or multiple gases such as an inert gas (e.g., He, Ar, or $_{N2}$), non-inert gas, other gaseous byproducts, and the like.

A "cycle" or "process cycle" may be a retort measurement or verification step, for example, fine measurement cycle, coarse measurement cycle, or atmospheric conditions within the reaction chamber. Moreover, terms such as "process method", "process cycle", and the like, may be used interchangeable without deviating from the nature and scope of the disclosure.

A "desired level" or "acceptable range" for processing may depend on various factors such as the substrate material processing method, and type of retort. However, for processing gas turbine engine parts, an acceptable range for dewpoint content may be between 0° F. and −40° F., and for oxygen or $O_2$ content may be 800 parts-per-million (ppm) or less, with other ranges certainly being possible.

Figure 2:
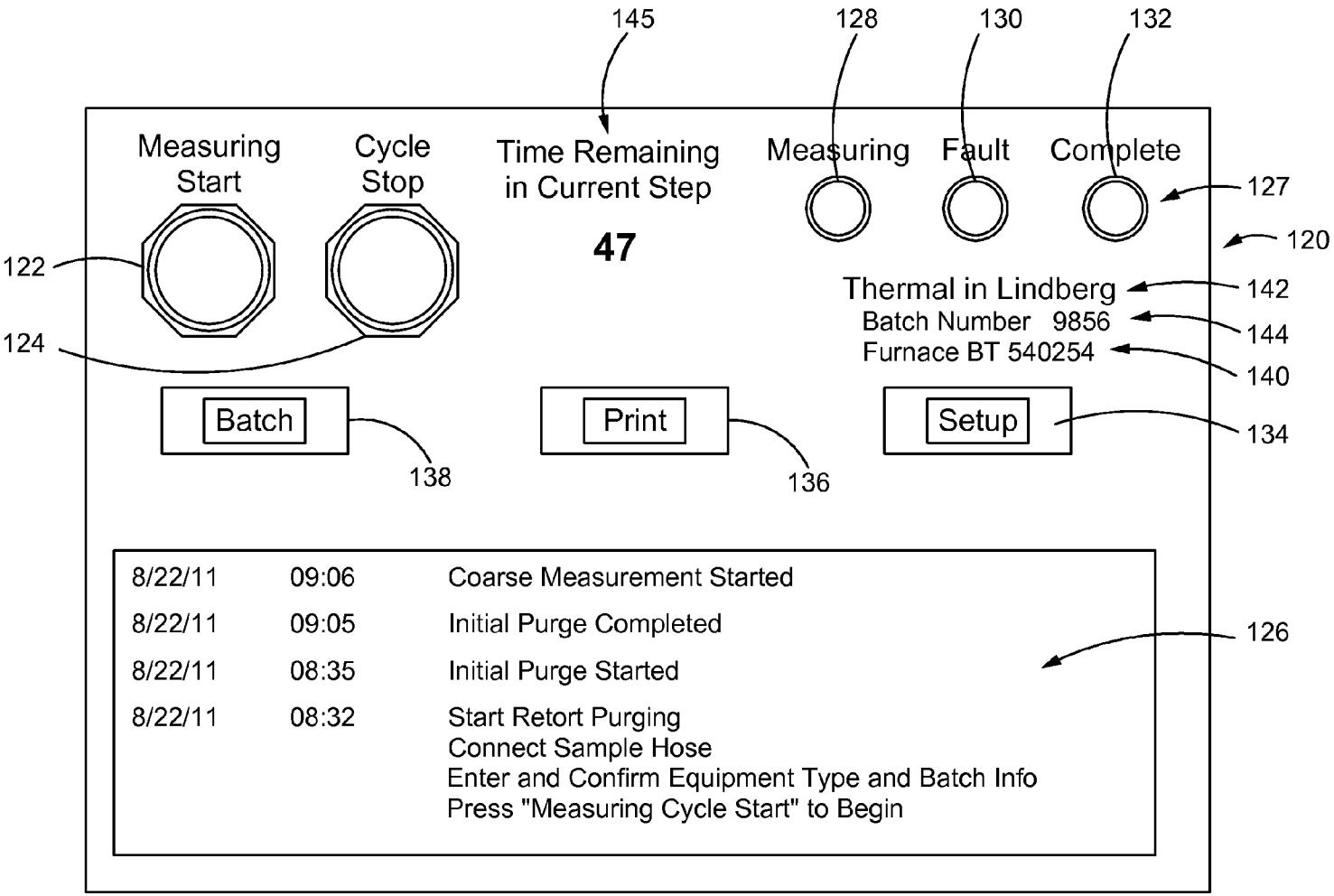
FIG. 2 is an exemplary operator interface display and operator interface that may be used to implement operator interactions for the verification and measurement processes of the apparatus and method, according to some embodiments of the disclosure.

Referring to FIG. 2, the operator interface 105 is shown for the automated measurement and verification system 100. In the depicted embodiment, the operator interface 105 provided in the form of a touch screen display 119; although other forms of input/output devices could be employed as mentioned above. A main screen 120 of the display 119 allows the operator to manually start and stop a measuring cycle using measuring cycle start button 122 and measuring cycle stop button 124, respectively. Moreover, the operator can also view the status of the cycle process in the event log 126. The operator can view from a cursory glance or, at a distance, where in general the cycle process is through status indicator lights 127. Such lights 127 may include measuring light 128, fault light 130, and complete light 132. The operator can also record measurements with print button 136, and select measurement parameters with parameter button 138. More specifically, the setup button 134 may allow the engineer to enter step times for the measurement and verification steps, for example, initial purge time, coarse measurement time, and fine measurement time, and number of retries for each process. Additionally, the operator may select a specific retort or process type and process parameters for automating substrate processing. The print button 136 allows the operator to select process parameters for printing. The Batch button 138 allows the operator to set the furnace and cycle type, batch number, and Furnace ID number, which are displayed on the main screen 120 as furnace ID number 140, furnace/cycle type 142, and batch number 144. Finally, a countdown timer 145 is provided to show how much time is left in a given cycle being performed.

Referring to FIGS. 3A-3E, a flow chart depicting the sequence of steps within the PLC software which may be practiced by the automated measurement and verification system 100 is shown. As shown, operator interaction with the system 100 is through the display unit 119 of the operator interface 105. The system 100 may process a retort environment in accordance with the following three stages: a purge stage to prepare the environment for processing; a coarse measurement stage to prepare dewpoint and oxygen levels; and a fine measurement stage to set dewpoint and oxygen levels at optimum levels for processing a substrate. Of course, other stages can be included as well and still be within the scope of the present disclosure.

Figure 3A:
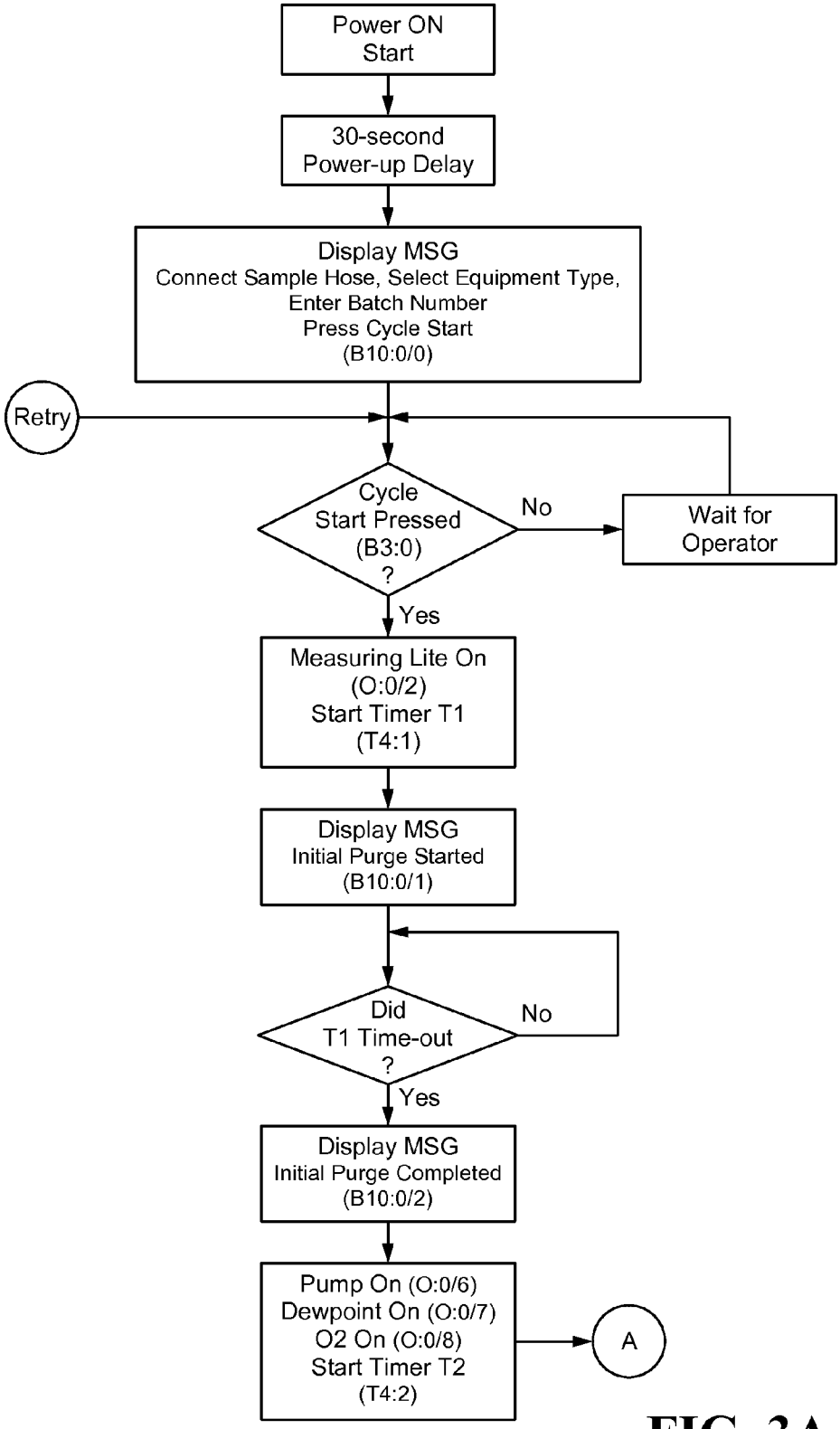
FIGS. 3A-3E depict a flow chart illustrating PLC software control within the automated measurement and verification system and the display unit of the operator interface, according to some embodiments of the disclosure.

Starting with the purge stage, and referring specifically to FIG. 3A, it begins by powering on the system 100 and then following with a predetermined delay, such as but not limited to 30 seconds, for example. After connecting the retort 111 to the system 100, the operator is prompted to enter process information prior to beginning a cycle to purge the retort 111. Process information may include, but not be limited to, selecting an equipment type and entering a batch number. Once the process information is confirmed by the operator, cycle start button 122 is enabled, allowing the operator to begin the process of purging the retort environment. Once the cycle start button 122 is pressed, the measuring light 128 turns yellow showing the purge has initiated, a measuring message is displayed on event log 126, a purge time T1 is initiated, and an initial purge message is displayed until the period for the purge is completed. Of course, the specific color used may vary, and not be one of the red, green, and yellow colors provided herein as examples.

Figure 3B:
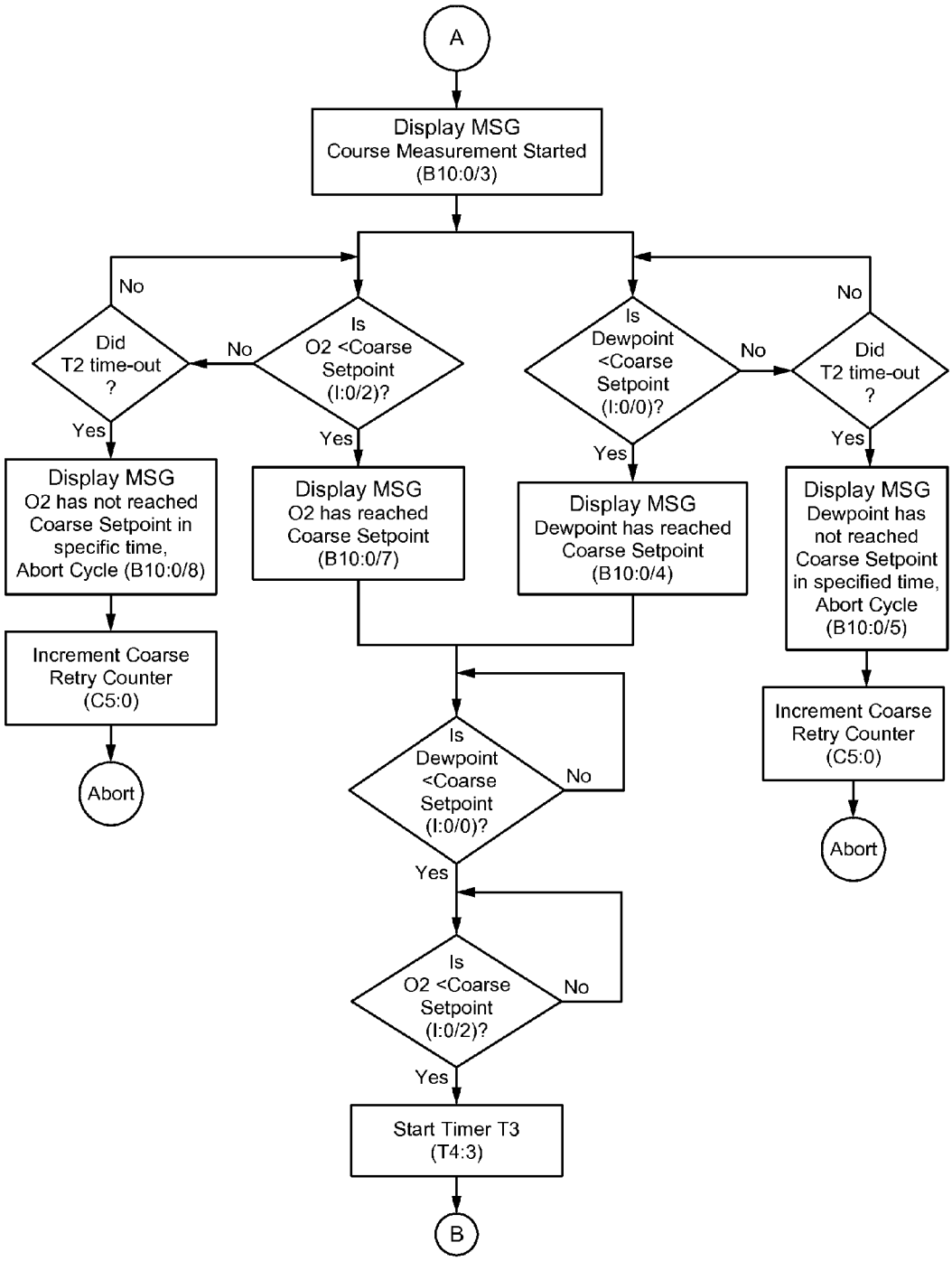

Referring to FIG. 3B, following the purge stage, a coarse measurement stage is initiated for concurrently sampling oxygen and dewpoint levels in the retort 111. The sampling process of coarse measurement stage may include, but not be limited to, turning on a sample pump, turning on trace gas sensor(s), for example, dewpoint sensor 115 and oxygen sensor 113, initiating a sampling period time T2, and displaying a course measurement message to notify the operator that the sampling process for oxygen and dewpoint has begun.

In the oxygen portion of the sampling process, oxygen threshold levels are tested for a coarse setpoint. If the coarse setpoint for oxygen has not been reached, the sampling process resumes testing for oxygen coarse setpoint until the sampling period time T2 is reached. If oxygen coarse setpoint is reached within the sampling period time T2, the success of the process is posted to the operator interface 105, and sampling process continues with the dewpoint portion of the coarse measurement stage described below. If after the sampling period time T2 the oxygen coarse setpoint is not reached, the cycle is aborted, the measuring light 128 turns red showing the sampling process has failed, and the operator is notified that oxygen coarse setpoint had not been reached within the specified sampling period. The software increments the coarse retry counter and the sampling process is sent to an abort stage.

In the dewpoint portion of the sampling process, and concurrent with the oxygen sampling process stated above, dewpoint threshold levels are tested for a coarse setpoint. If the coarse setpoint for dewpoint has not been reached, the sampling process resumes testing for dewpoint coarse setpoint until the sampling period time T2 is reached. If dewpoint coarse setpoint is reached within the sampling period time T2, the success of the process is posted to the operator interface 105, and sampling process continues with the oxygen portion of the coarse measurement stage described above. If after the sampling period time T2 the dewpoint coarse setpoint is not reached, the cycle is aborted, the measuring light 128 turns red showing the sampling process has failed, and the operator is notified that dewpoint coarse setpoint had not been reached within the specified sampling period. The software increments the coarse retry counter and the sampling process is sent to an abort stage. Once dewpoint and oxygen coarse setpoint levels are reached within the sampling period time T2 in the coarse measurement stage, the system begins the fine measurement stage.

Figure 3C:
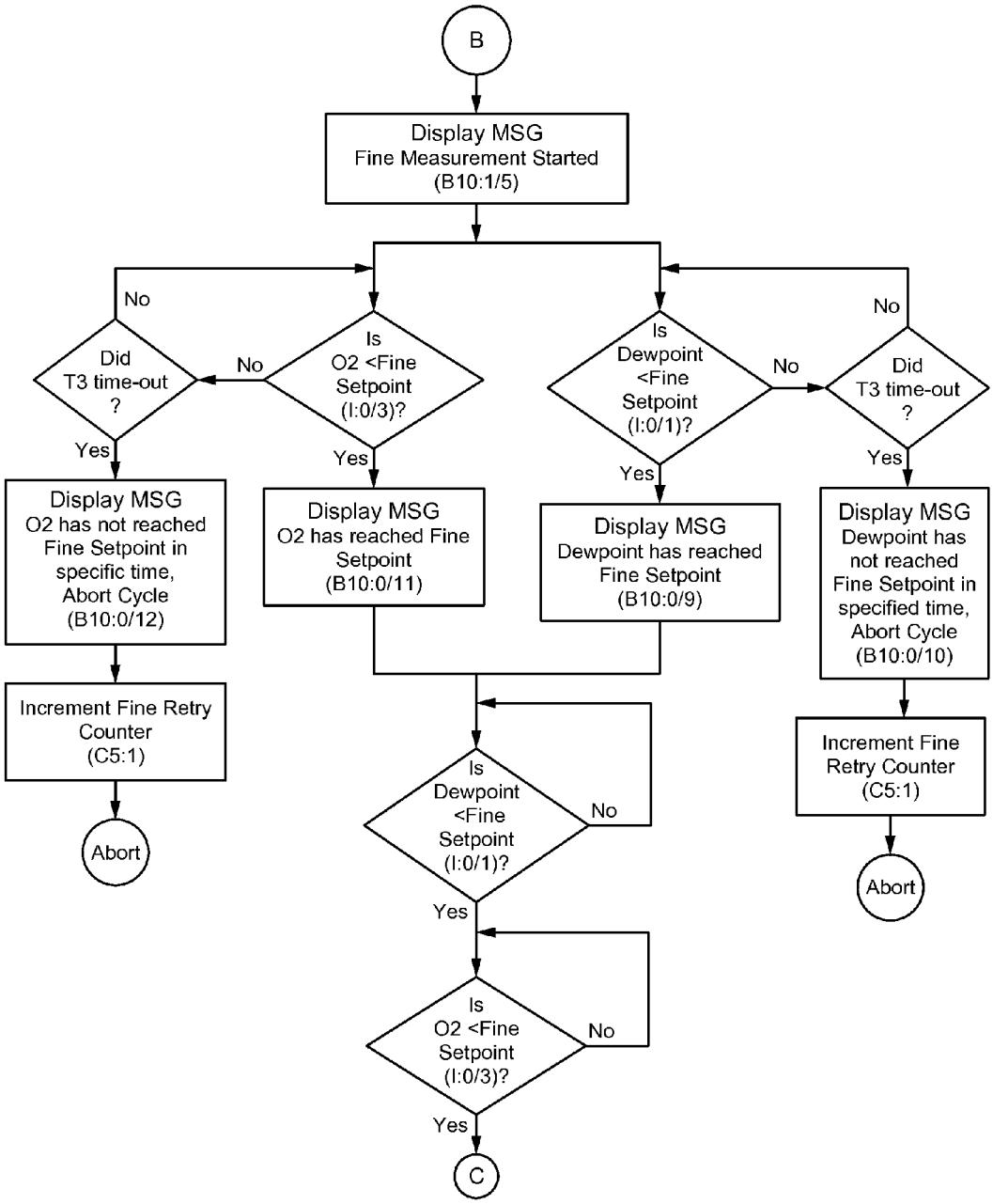

Referring to FIG. 3C, following the coarse measurement stage, a sampling period time T3 for fine measurement stage is initiated for concurrently sampling oxygen and dewpoint levels in the retort 111, and a fine measurement message is displayed in event log 126 to indicate to the operator the fine measurement stage has begun.

In the oxygen portion of the sampling process, oxygen threshold levels are tested for a fine setpoint. If the fine setpoint for oxygen has not been reached, the sampling process resumes testing for oxygen fine setpoint until the sampling period time T3 is reached. If oxygen fine setpoint is reached within the sampling period time T3, the success of the process is posted to the operator interface 105, and the sampling process continues with the dewpoint portion of the fine measurement system described below. If after the sampling period time T3, the oxygen fine setpoint is not reached, the cycle is aborted, the measuring light 128 turns red showing the sampling process has failed, and the operator is notified that oxygen fine setpoint had not been reached within the specified sampling period. The software increments the fine retry counter and the sampling process is sent to an abort stage.

In the dewpoint portion of the sampling process, and concurrent with the oxygen sampling process stated above, dewpoint threshold levels may be tested for a fine setpoint. If the fine setpoint for dewpoint has not been reached, the sampling process resumes testing for dewpoint fine setpoint until the sampling period time T3 is reached. If dewpoint fine setpoint is reached within the sampling period time T3, the success of the process is posted to the operator interface 105, and sampling process continues with the oxygen portion of the fine measurement system described above. If after the sampling period time T3 the dewpoint fine setpoint is not reached, the cycle is aborted, the measuring light 128 turns red showing the sampling process has failed, and the operator is notified that dewpoint fine setpoint had not been reached within the specified sampling period. The software increments the fine retry counter and the sampling process is sent to an abort stage.

Figure 3D:
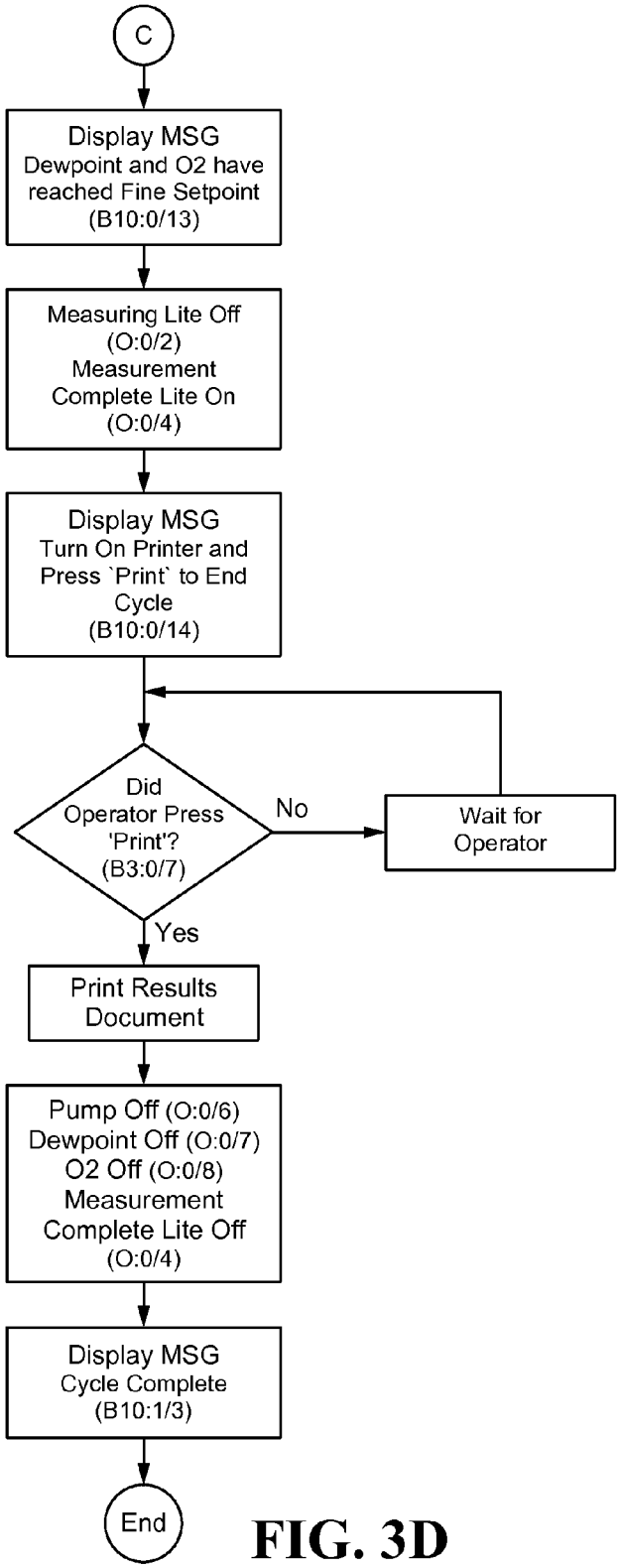

Referring to FIG. 3D, once dewpoint and oxygen fine setpoint levels are reached within the sampling period time T3 in the fine measurement stage, the measuring light 128 turns green showing the sampling process for the fine measurement stage has succeeded and a message showing dewpoint and oxygen have reached fine setpoint is displayed in event log 126. The measuring light 128 is then turned off, and the measurement complete light 132 is turned on. A print message may then be displayed for the operator, and the cycle is ended once a printout request of process results is made. A "cycle complete" message can then be displayed on operator interface 105.

Figure 3E:
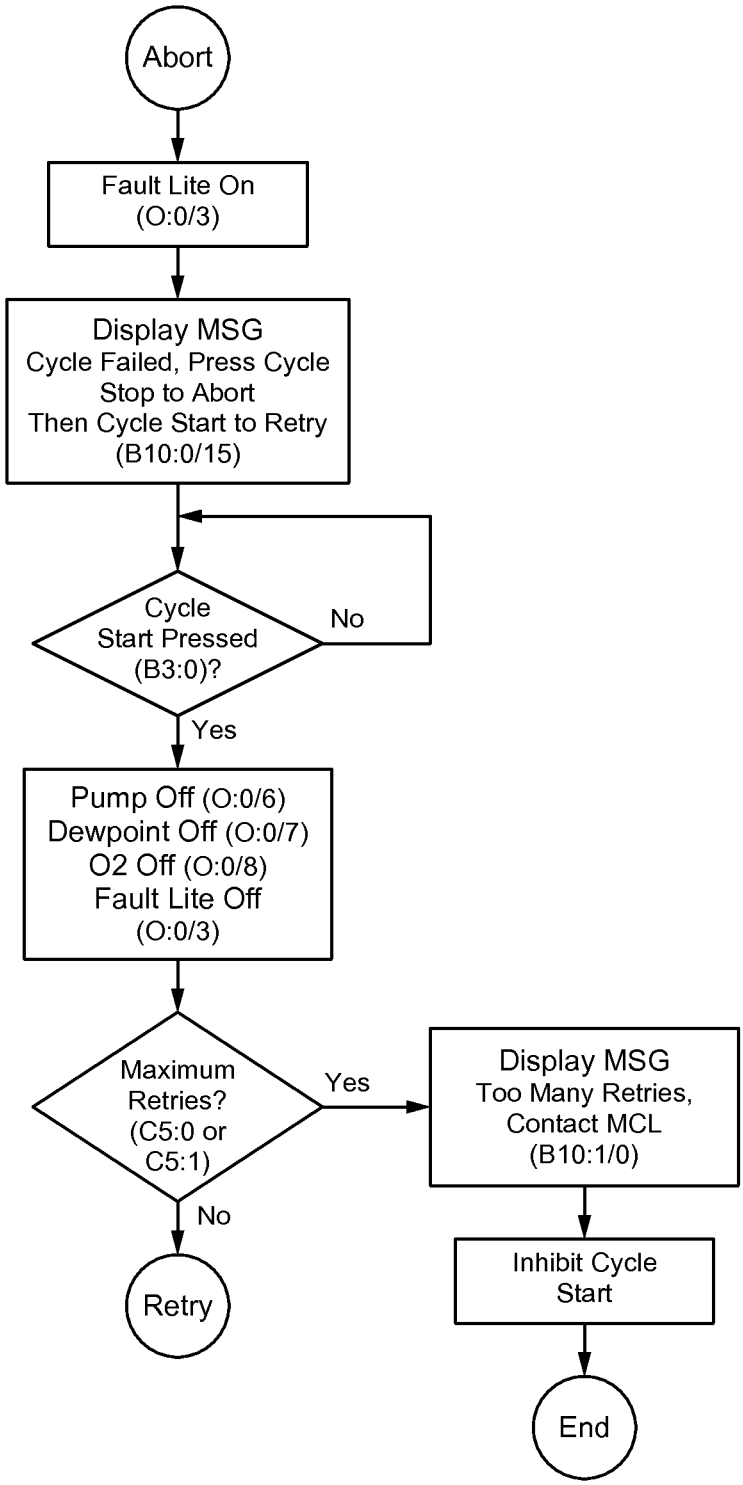

Referring to FIG. 3E, in the event that in the coarse or fine measurement stage an abort request is made, the measuring light 128 turns red showing the sampling process has failed, the fault light 130 turns on, and "cycle failed" message is displayed. The operator is then given the option to abort the cycle or restart the cycle. Once the cycle start button 122 is pressed, the fault light 130 is turned off. In the event that the maximum number of retries for the cycle is not reached, the cycle in which an abort request was made is retried. However, if the maximum number of retries is reached, a message may be displayed to notify the operator that too many retries have been made in the cycle and the operator is requested to contact operations and manufacturing personnel. The cycle is then prevented from starting and the cycle ends.

Figure 4:
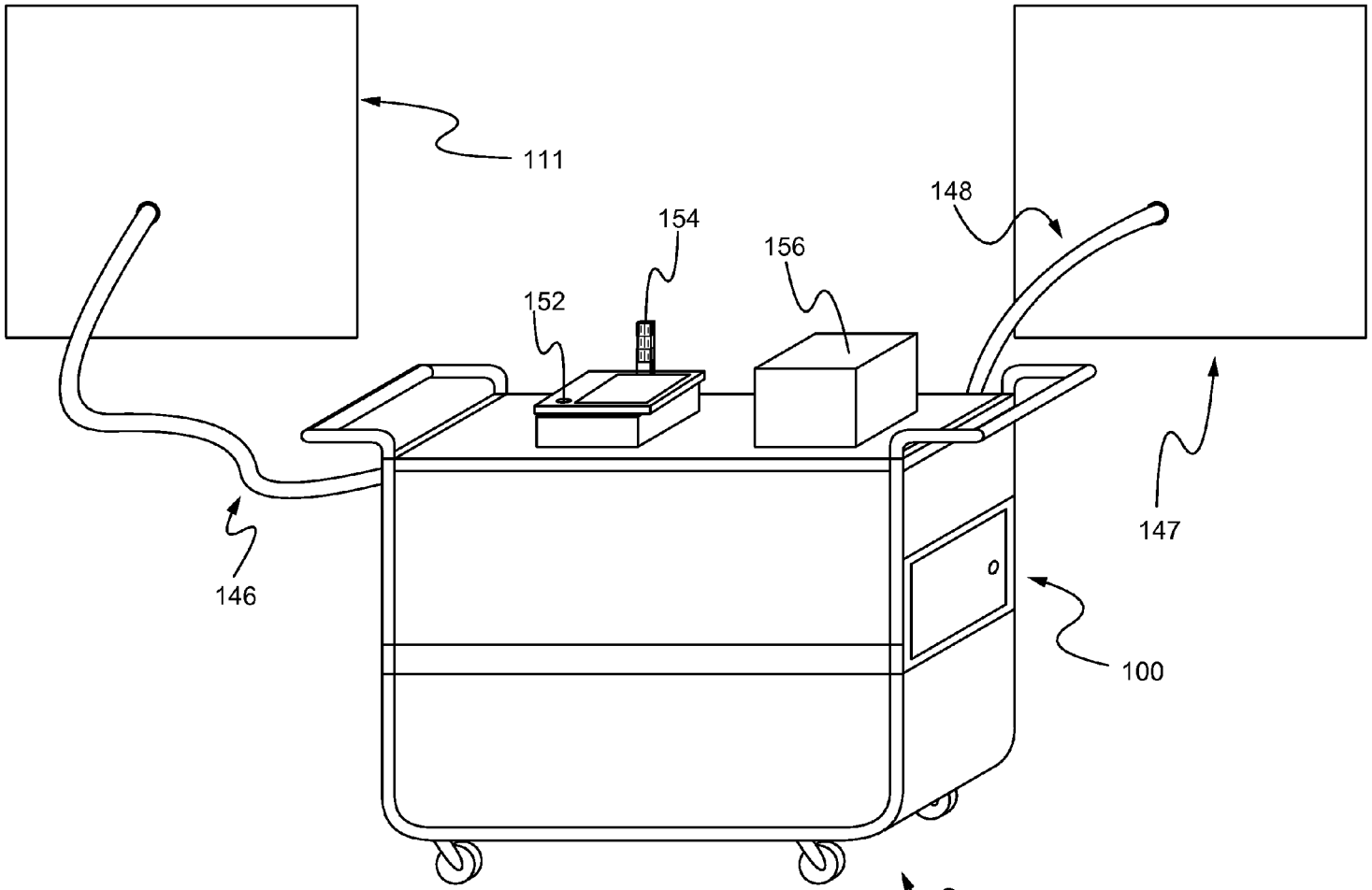
FIG. 4 is a perspective view of a retort, the control panel of the retort, and the automated measurement and verification system, according to some embodiments of the disclosure.

Referring to FIG. 4, one embodiment of a physical setup between the retort 111 and the automated measurement and verification system 100 is shown. As shown, the automated measurement and verification system 100 may be configured to connect to the retort 111 through a coupler 146, and to process gases 147 by way of a coupler 148. In this exemplary embodiment, the automated measurement and verification system 100 may be mounted on or attached to the portable cart 107 allowing the operator and cart 107 to move between substrate processing stations.

As indicated above, the automated measurement and verification system 100 includes an integrated measurement system for measuring trace gases and atmospheric conditions such as dewpoint and oxygen within the retort 111. When connected to the retort 111 via the coupler 146, sensors 113 and 115 sense oxygen and dewpoint levels, respectively, and communicate their findings to an operator through the operator interface 105. The automated measurement and verification system 100 may also includes a power switch 152 to allow an operator to terminate processing inside the retort 111, and a stack light 154 mounted on the cart 107 to allow an operator to quickly view, at a distance, the cycle process status. In the exemplified embodiment, the automated measurement and verification system 100 may provide the operator interface 105 in the form of a touch screen panel 119 as indicated above, and may also include a printer 156 for printing process results.

While the present disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. As will be further appreciated, the processes in embodiments of the present disclosure may be implemented using any combination of software, firmware, or hardware. Therefore, it is intended that the disclosure not be limited to the particular embodiments disclosed for carrying out this disclosure, but that the disclosure will include all embodiments falling within the scope of the appended claims.

INDUSTRIAL APPLICABILITY

An example where an automated measurement and verification system can be implemented is in the manufacture of turbines and other components used on gas turbine engines and other aircraft components. For example, aluminide coating processes used in gas turbine engine parts requires the retort environment in which the component is coated or heat treated to be purged with argon or another inert gas to establish proper conditions. Following the purge, an operator typically, and manually, monitors all process parameters to ensure they are achieved and within a certain threshold to prevent causing deficiencies in the processed parts, as well as damage to the measuring equipment. The present disclosure automates the process of purging the retort, and monitoring and verifying retort conditions, thereby freeing up the operator to monitor multiple stations and minimizing human intervention in the manufacturing process.

It should be understood that various changes and modifications to the present embodiments described herein will be apparent to those skilled in the art. Such changes and modifications may be made without departing from the spirit and scope of the present disclosure and without diminishing its intended advantages. It is therefore intended that such changes and modifications be covered by the appended claims.

What is claimed is:

1. An apparatus for automating dewpoint and oxygen level verification within a retort for coating or heat treating substrates, the apparatus comprising:

an integrated measuring system, the integrated measuring system being communicatively coupled to the retort, and measuring dewpoint and oxygen levels inside the retort, the retort comprising a site for substrate processing; and an operator interface communicatively coupled to the integrated measuring system, the operator interface automatically communicating whether the dewpoint and oxygen levels inside the retort are within an acceptable range.

2. The apparatus according to claim 1, further including indicators to notify an operator that retort atmospheric conditions are sufficient to allow insertion and refraction of a substrate into and out of the retort.

3. The apparatus of claim 2, wherein the indicators are lights.

4. The apparatus according to claim 3, wherein the integrated measuring system comprises a dewpoint sensor.

5. The apparatus according to claim 4, wherein the dewpoint sensor measures moisture content inside the retort.

6. The apparatus according to claim 2, wherein the integrated measuring system comprises an oxygen sensor.

7. The apparatus according to claim 6, wherein the oxygen sensor measures oxygen content inside the retort.

8. The apparatus according to claim 1, wherein the operator interface comprises a display panel.

9. The apparatus according to claim 8, wherein the display panel comprises a main screen showing the current status of the process, and a menu for accessing other screens.

10. The apparatus according to claim 9, wherein the main screen of the display panel comprises an event log and indicator lights displaying measuring cycle and process status.

11. The apparatus according to claim 9, wherein the menu of the main screen of the display panel enables modification of system and process parameters.

12. A method for automating dewpoint and oxygen level verification within a retort for coating or heat treating substrates, the method comprising the steps of:

a.) providing an apparatus comprising i. an integrated measuring system, the integrated measuring system being communicatively coupled to the retort, and measuring dewpoint and oxygen conditions inside the retort, and ii. an operator interface communicatively coupled to the integrated measuring system, the operator interface automatically communicating whether the dewpoint and oxygen levels inside the retort are within an acceptable range;

b.) purging the retort with an inert gas;

c.) activating the integrated measuring system; and d.) verifying dewpoint and oxygen levels within the retort using the integrated measuring system.

13. The method of claim 12, wherein during steps b.) through d.), indicator lights on a display panel of the operator interface are illuminated in response to completion of a step.

14. The method of claim 13, further comprising a step e.) of attaching the apparatus to a different retort and performing steps b.) through d.) on same.

15. The method of claim 12, further comprising a step e.) of repeating step d.) for a desired treatment time.

16. The method of claim 15, further comprising the step of indicating heat treatment should not be performed once the integrated measuring system detects dewpoint in the retort is greater than 0° F.

17. The method of claim 12, wherein during the step of verifying the retort, dewpoint levels in the retort between 0° F. and −40° F. are acceptable.

18. The method of claim 12, wherein during the step of purging, argon is introduced into the retort.

19. An apparatus for automating dewpoint and oxygen level verification within a retort for coating or heat treating substrates prior to coating or heat treating, the apparatus comprising: a dewpoint sensor; an oxygen sensor; a processor receiving signals from the dewpoint sensor and oxygen sensor indicative of dewpoint and oxygen levels inside of the retort, respectively, the retort being purged with an inert gas; and an operator interface automatically communicating whether dewpoint and oxygen levels within the retort are within an acceptable range.

20. The apparatus of claim 19, wherein the sensors, processors and operator interface are all provided on a portable cart.

* * * * *